United States Patent [19]

Maynard, Jr.

[11] 4,351,454

[45] Sep. 28, 1982

[54] LIQUID CONTAINER HAVING STACKING FEATURE

[76] Inventor: Walter P. Maynard, Jr., Suite 236, 3070 Presidential Dr., Atlanta, Ga. 30340

[21] Appl. No.: 169,300

[22] Filed: Jul. 16, 1980

[51] Int. Cl.[3] ..... B67D 5/60; B65D 21/02

[52] U.S. Cl. ..... 222/143; 222/529; D9/370; D9/378

[58] Field of Search ..... 222/143, 465, 466, 529, 222/530, 538; 206/503, 508, 509, 510; D9/370, 378

[56] References Cited

U.S. PATENT DOCUMENTS

| | | | |
|---|---|---|---|
| 2,757,829 | 8/1956 | Ahlquist | 222/527 |
| 3,441,180 | 4/1969 | Ganung | 222/143 |
| 3,831,817 | 8/1974 | Leccese | 222/143 |

*Primary Examiner*—David A. Scherbel

*Attorney, Agent, or Firm*—Newton, Hopkins & Ormsby

[57] ABSTRACT

A unitary liquid container formed of molded plastics material has a flexible filling and pouring nozzle of sufficient size to be self-venting. The top of the nozzle, when in an upright position, coacts with a top surface on the container lifting handle to form a level stacking surface. A manipulating recess is provided near the bottom of the container.

4 Claims, 7 Drawing Figures

LIQUID CONTAINER HAVING STACKING FEATURE

BACKGROUND OF THE INVENTION

The invention relates to a lightweight durable, less expensive and more convenient container for bulk liquids, such as gasoline. Liquid containers of this type are commonly formed of metal, are quite expensive and quite heavy. They usually include separately attached pouring nozzles which are difficult to seal with an outlet opening of the container. The prior art containers commonly have a separate relatively large filler opening and closure cap and a separate venting means, such as a plastic snap action vent plug which requires opening during pouring of the liquid contents through the relatively narrow nozzle or spout.

The present invention seeks to improve on and greatly simplify the above prior art arrangement by providing a low cost preferably blow molded plastics container having an integral carrying handle and an integral flex pouring nozzle of sufficient size to be self-venting and to allow filling of the container with gasoline or the like through the pouring nozzle, thus eliminating the usual separate filling opening and cap, separate venting means, and separately formed carrying handle.

The container embodying the invention also has a molded lower and finger receiving recess to help in manipulating the container. A further feature of the invention is that the top of the pouring nozzle and its closure cap, when upright, forms a continuation of a flat top surface on the lifting handle sufficiently large to allow the stacking of plural containers with intervening cardboard separators or directly with containers having recessed bottoms in accordance with one embodiment of the invention.

Other features and advantages of the invention will become apparent during the course of the following description.

DETAILED DESCRIPTION

Figure 1:
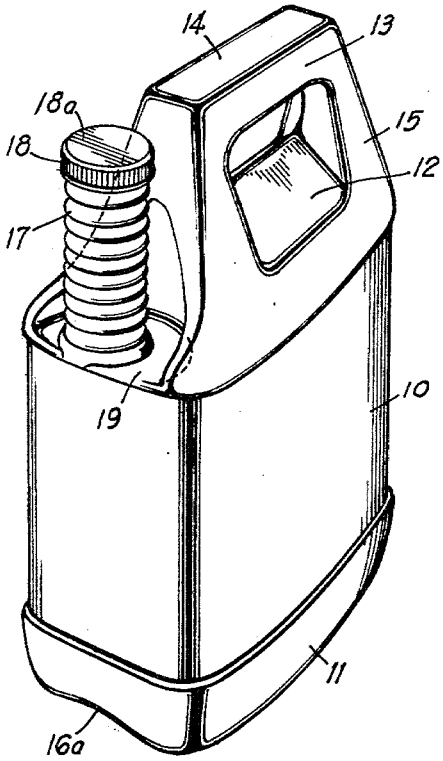
FIG. 1 is a perspective view of a liquid container according to one embodiment of the invention.

Referring to the drawings in detail wherein like numerals designate like parts, a unitary plastics material container having an interior capable of containing a supply of liquid or other dispensing material and adapted for blow molding. The container comprises a roughly rectangular upstanding body portion 10 having a slightly enlarged base 11 and a crowned or gabled top

Figure 4:
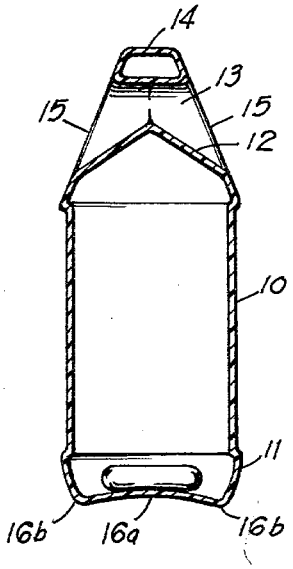
FIG. 4 is a vertical section taken on line 4—4 of FIG. 3.

12 surmounted by a hollow lifting and carrying handle 13 having a flat top surface 14 to promote stacking with other containers. As best shown in FIGS. 1 and 4, the opposite side faces 15 of the lifting handle 13 are essentially flat and upwardly converging in symmetrical relationship to the adjacent crowned container top wall 12. A manual grasping aperture **15*a* is defined by the top surface 14 and the opposite side faces 15**.

At its lower rear corner, the container is provided with an inclined elongated finger receiving recess 16 to facilitate manipulating the container as when pouring the contents thereof into an automobile gas tank or other receiver. The bottom surface **16*a* has a longitudinally extending, arcuate-shaped depressed area with opposed side edges 16*b*** which engage a horizontal support surface to maintain the container in an upright attitude.

Figure 3:
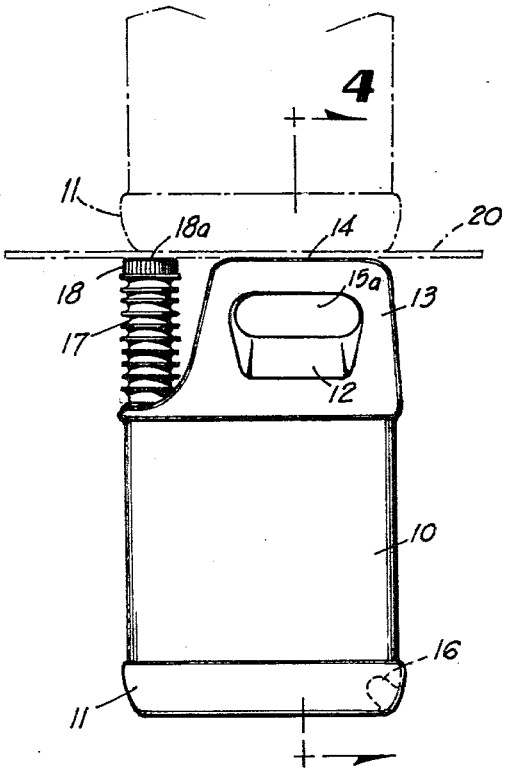
FIG. 3 is a side elevation of the container illustrating the stackability thereof.

The liquid container also possesses an integral flexible pouring nozzle or spout 17 which is in communication with the interior of the body portion 10 and having a removable end closure means or cap 18 for the open end of the nozzle 17. The integral nozzle 17 rises from a horizontal ledge 19 formed on the container immediately forwardly of the lifting handle 13. When the flexible nozzle 17 is upright, FIGS. 1 and 3, the combined width dimension across the handle 13 and nozzle does not exceed the width of the container body 10, as viewed in FIG. 3.

When the nozzle 17 is upright, the top face **18*a* of its cap 18 is aligned or co-planar with and forms a continuation of the top surface 14 of the handle 13 and this arrangement allows stacking of plural containers as indicated in FIG. 1 with intervening flat separators 20** formed of cardboard or the like. The container as described is lightweight, durable, highly convenient and very inexpensive. It is useful for storing and dispensing a wide range of bulk liquids including gasoline and many household liquids including beverages.

Figure 2:
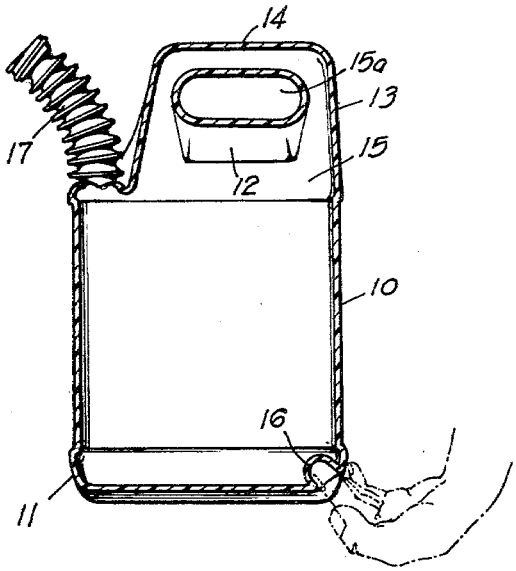
FIG. 2 is a central vertical section through the container of FIG. 1 on a reduced scale with the pouring nozzle or spout flexed.
Figure 5:
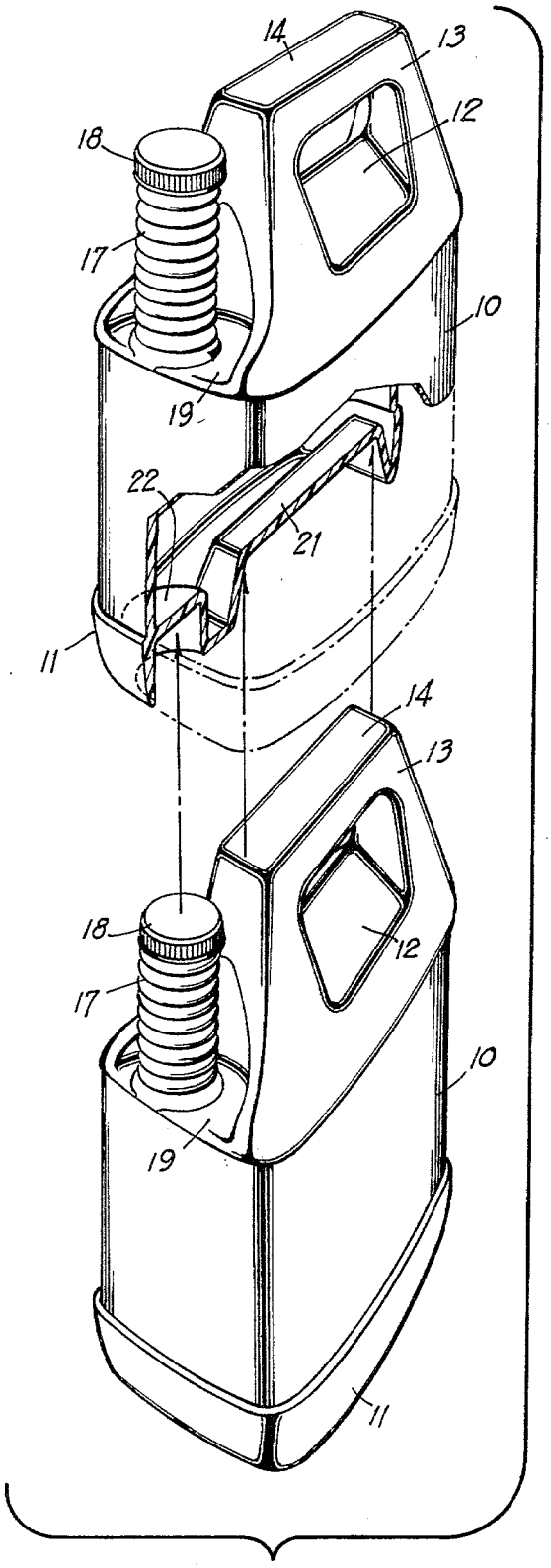
FIG. 5 is an exploded perspective view, partly in section, showing a stackable liquid container according to a second embodiment of the invention.
Figure 6:
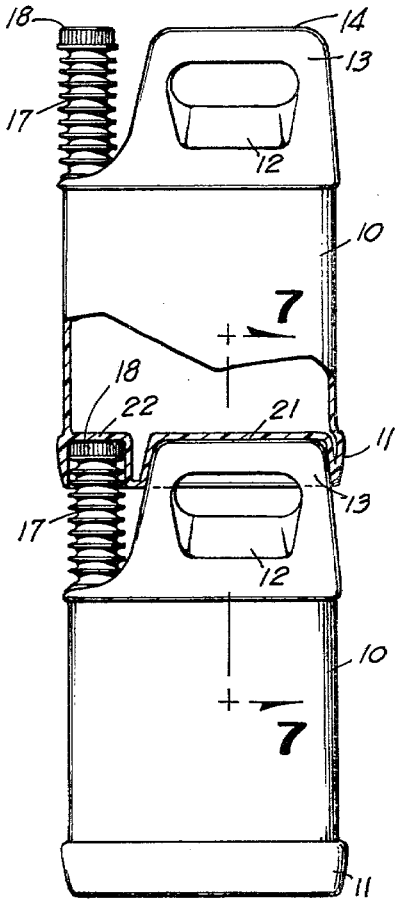
FIG. 6 is a side elevation on a reduced scale, partly in section, of two stacked containers according to the second embodiment.
Figure 7:
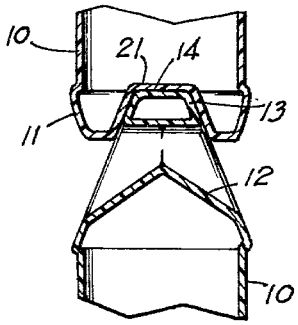
FIG. 7 is a fragmentary vertical section taken on line 7—7 of FIG. 6.

In a second embodiment of the invention shown in FIGS. 5 through 7, the construction and usage of the liquid container is identical to that of the embodiment in FIGS. 1 to 4 except as follows: the bottom surface of the container has a main crowned recess 21 and a secondary cylindrically formed recess 22, of like depth measured from the bottom of the container. As shown in FIG. 6, the top portion of handle 13 and the capped top of upright nozzle 17 are received in the two recesses 21 and 22 when plural containers are stacked. The need for the cardboard separator 20 is eliminated. The back of recess 21 may also serve as a finger grip in manipulating the container substantially as indicated in FIG. 2. All other features are the same as above described for the first embodiment in FIGS. 1 to 4.

In both embodiments of the invention, the inner diameter of the flex nozzle 17 is of a sufficient size to be filled by means of the dispensing nozzle of a standard gasoline pump or the like. The size of the nozzle renders it self-venting and thus eliminates the need for another vent on the containers, as is customary.

It is to be understood that the forms of the invention herewith shown and described are to be taken as preferred examples of the same, and that various changes in the shape, size and arrangement of parts may be resorted to, without departing from the spirit of the invention or scope of the subjoined claims.

What I claim is:

1. A liquid container formed as a unit from plastics material comprising a body portion having a bottom surface, a gabled upper surface, a hollow top carrying handle on said body portion which surmounts said gabled upper surface, a pouring and filling nozzle integrally formed on the top of said body portion and having a sufficiently large interior diameter to be self-venting and to facilitate filling the container through said nozzle, said nozzle being flexible along its length, and a removable closure means for said nozzle so that when said nozzle is upright, the top of said closure means is flush with the top of said handle, said top of said handle and said top of said closure means forming a surface to promote stacking the container with other like containers, said handle having flat, opposite side faces upwardly converging in symmetrical relationship from said body portion and terminating to said top of said handle, said side faces and said top defining a manual grasping aperture and said bottom surface having a longitudinally extending, arcuate-shaped depressed area with opposed side edges and including a manipulating recess on the lower end of said container adjacent said bottom surface and including a main recess in the bottom of said container and a secondary recess in said bottom surface forwardly of said main recess, said main and secondary recesses adapted to receive the upper portion of said handle and the top of the flexible nozzle of an underlying container when two containers are stacked while said nozzle is upright.

2. A liquid container as defined in claim 1, and said main recess being a crowned recess having a flat top wall, said secondary recess being cylindrically formed and having a flat top wall at the same elevation as said flat top wall of said crowned recess.

3. A liquid container as defined in claim 1, and the top wall of said carrying handle being flat and elongated from the back of the container forwardly toward said nozzle.

4. A liquid container as defined in claim 1, and said nozzle rising from a substantially level ledge on the top of the container immediately forwardly of said handle.

* * * * *